US005554972A

United States Patent [19]

Byrne

[11] Patent Number: 5,554,972

[45] Date of Patent: Sep. 10, 1996

[54] ELECTRONIC PERIMETER WARNING SYSTEM

[75] Inventor: Brian T. Byrne, Chanhassen, Minn.

[73] Assignee: Garlock Equipment Company, Minneapolis, Minn.

[21] Appl. No.: 327,544

[22] Filed: Oct. 21, 1994

[51] Int. Cl.[6] ..... G08B 13/18

[52] U.S. Cl. ..... 340/556; 250/221; 340/552

[58] Field of Search ..... 340/556, 552, 340/554, 693, 502; 250/221; 256/10

[56] References Cited

U.S. PATENT DOCUMENTS 4,187,501 2/1980 Olesch ..... 340/552
4,191,953 3/1980 Woode ..... 340/552
4,760,381 7/1988 Haag ..... 340/552
5,198,799 3/1993 Pascale ..... 340/552

*Primary Examiner*—Brent A. Swarthout
*Assistant Examiner*—Albert K. Wong
*Attorney, Agent, or Firm*—Alan D. Kamrath; Keith J. Goar

[57] ABSTRACT

Apparatus and method are disclosed to provide an electronic perimeter warning system to prevent the ingress or egress of persons or machines from a selected area such as in an area along the perimeter of a roof under construction. Battery powered signal transmitters and receivers establish a signal beam between two locations. When the continuity of the signal beam is broken, an alarm is sounded to warn the person who is crossing the signal beam of imminent danger.

11 Claims, 2 Drawing Sheets

ELECTRONIC PERIMETER WARNING SYSTEM

FIELD OF THE INVENTION

This invention relates to the need to provide a perimeter warning system to prevent the ingress or egress of persons or machines from a selected area such as would be needed in the roofing industry. More particularly, apparatus and method are described for providing portable electronic warning apparatus positionable along the perimeter of an area, such as the edge of a roof, to detect movement of workers or equipment near the roof edge. An alarm is thereby sounded to warn of the imminent danger and to prevent accidental falls from the roof.

BACKGROUND OF THE INVENTION

The commercial construction industry has long experienced a variety of accidents wherein workmen and equipment exit or enter an area where there is danger. With regard to the roofing industry, given the frequency with which workmen must work and operate machinery in a rooftop setting, falls from the roof edges occur in a variety of somewhat predictable circumstances. One recurring circumstance which gives rise to roof top falls is that of workmen who inadvertently lose track of their proximity to a roof edge while working. They may stray toward a roof edge without being aware of it due to their concentration on the task at hand or due to the very manner in which they must move, including backing up, as they carry out roofing tasks. Another recurring circumstance giving rise to roof top falls is when a workman is involved in the operation of a piece of roofing equipment. In such circumstances, the workman often does not see the area in front of the equipment or may take his vision from the path along which he is travelling as he monitors or operates the equipment. This may lead to the equipment moving over the edge of a roof leading to an unexpected event which may also place the operator of the equipment in danger of falling from the roof.

Historically the roofing industry has attempted to minimize the occurrence of circumstances in which a workman is placed dangerously close to a roof edge by adopting a variety of safety regulations pertaining to roof top work. These include various regulations, including those promulgated by the Occupational Safety and Health Administration (OSHA) and adopted by most states. These regulations require that a variety of warning lines, personnel monitoring procedures, and perimeter guard rails be used near roof edges to prevent falls.

Traditional perimeter warning systems and barriers have a variety of shortcomings. First, the personnel monitoring systems rely upon human observation to warn workers of roof edge dangers. These are susceptible to failure by the mere fact that humans make mistakes. Secondly, the warning line systems are bulky in that they require a large number of upright stanchions, with heavy weighted bottoms, to surround the perimeter of a large commercial roofing project. Thus, a large amount of weight must be taken to the roof top and placed along a large perimeter. This is labor intensive and time consuming. In addition such systems, typically using a flexible line between stanchions, are prone to failure if the line is too slack or the workman does not sense the feel of the line, or it is impacted by equipment which does not sense its presence. In a third instance, rigid guard rails are utilized with very heavy base plates. These are designed to resist toppling by a falling person. By their very nature such systems are heavy, difficult and time consuming to emplace on a roof and are extremely expensive.

For all of the forgoing reasons, there has evolved in the commercial roofing industry an environment in which perimeter warning systems are not put in place when regulation requires that they be used. As a result, the incidence of falls and injuries increases. The present invention avoids these calamitous results by providing an inexpensive, effective and very portable electronic warning system with which to guard the perimeters of roofs upon which work is being undertaken.

SUMMARY OF THE PRESENT INVENTION

In accordance with the present invention there is provided apparatus and techniques for establishing a perimeter warning system for use in areas where it is desired to warn of egress, such as a work area like a roof under repair. The system is portable, light weight, and flexible in the distances it is intended to protect along the work area perimeter. It consists of an electronic signal transmitter and a signal receiver, between which is transmitted a detectible signal beam. In a preferred embodiment the signal being transmitted is a photoelectric signal or beam. The signal transmitter and receiver are each mounted on support means which are adjustable vertically to position the beam in a horizontal orientation at a selected height. Power means are provided for the transmitter as well as for the receiver, thus allowing the system to be fully portable, operating off of an integral power supply.

It is the purpose of the perimeter warning system to warn a worker when he, or machinery he is operating, crosses over the perimeter "line" established between the transmitter and receiver. This is accomplished by use of a horn element attached to the receiver unit. The horn is normally silent. However, when the signal beam continuity is interrupted, that is its continuity to the receiver is broken, sensing means are provided to detect this event and the horn sounds. In this way, the workman is instantly warned that he and/or equipment which he is operating, are moving into harms way, and, he can immediately undertake corrective action. Focusing means by which the transmitter and receiver can be properly aligned with one another are also provided.

The method disclosed by the present invention includes the steps of:

a) positioning opposed transmitting means and receiving means on a roof perimeter to define a perimeter warning "line";

b) establishing a continuous detectable signal beam between the transmitter means and the receiver means;

c) providing a sensing means which senses a break in the continuity of the signal beam;

d) providing an alarm means which is activated when the sensing means is triggered by the movement of personnel or equipment through the signal beam which interrupts its continuity;

e) mounting the transmitting and receiving means on support means which may be positioned at a selected height from the roof surface;

f) providing portable power means to the transmitting and receiving means;

g) providing alignment adjustment means to focus the signal beam between the signal transmitter and the signal receiver; and h) providing height adjustment means to adjust the height of the signal beam above the roof surface.

BRIEF DESCRIPTION OF THE DRAWINGS

The invention is described in more detail hereinafter with reference to the accompanying drawings, wherein like reference numerals refer to the same parts throughout the several views, and in which.

DETAILED DESCRIPTION OF THE INVENTION

Figure 1:
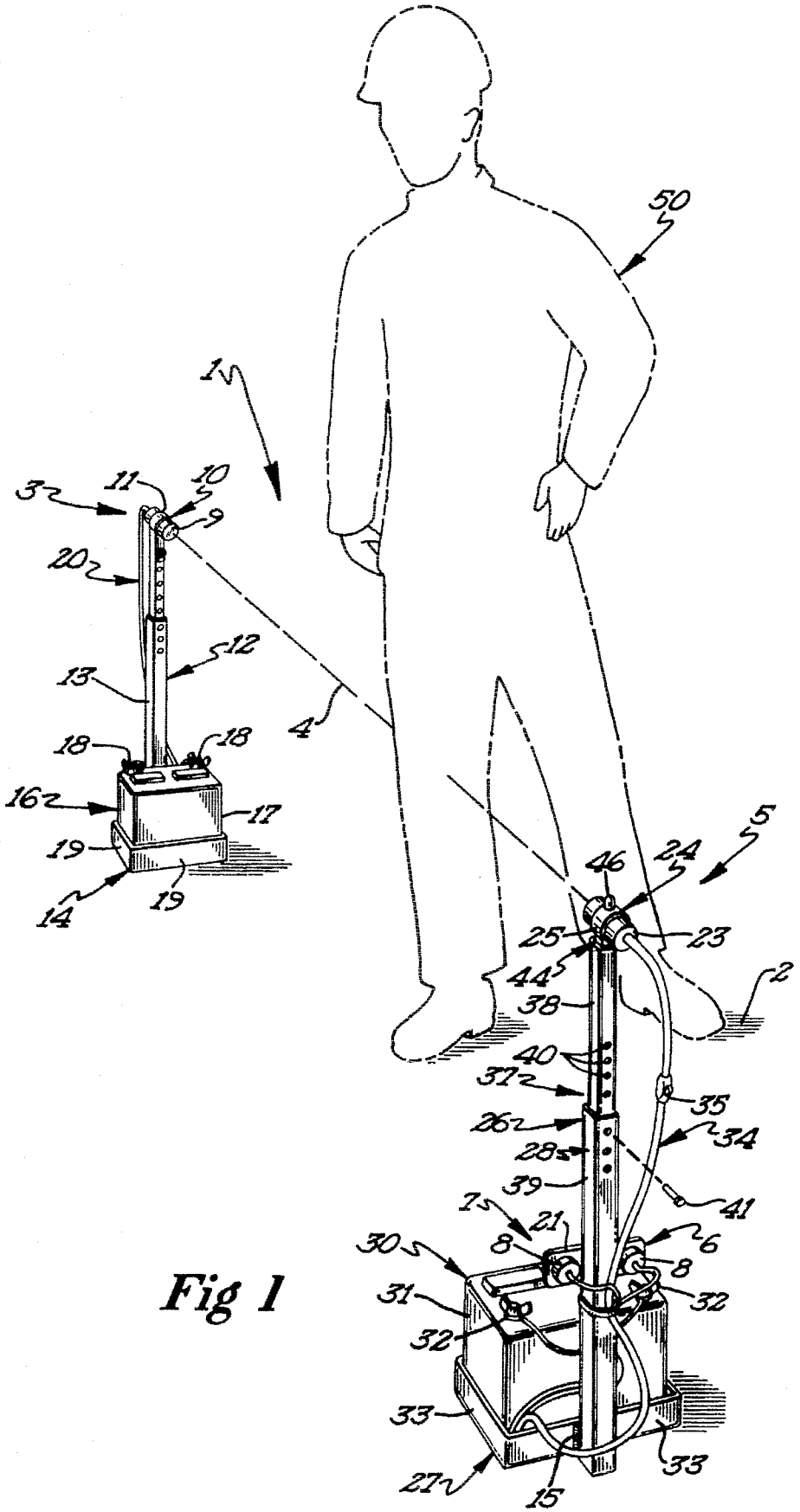
FIG. 1 is a front perspective view of the present invention mounted on a work surface.

In FIG. 1 there is shown in perspective view a preferred embodiment of the present invention. A perimeter warning system 1 is provided for establishing a perimeter warning line around a selected area, such as along a portion of a building roof surface 2. Also shown, in outline form, is the figure of a workman 50 as he may be positioned when coming into operable contact with perimeter warning system 1. Perimeter warning system i is comprised of signal transmitting means 3 and signal receiving means 5, each shown in FIG. 1. As will be described in more detail subsequently, signal transmitting means 3 emits a detectible signal beam 4 which travels along a straight line to signal receiving means 5. The detectible signal beam 4 being transmitted may be of a variety of types, including, but not limited to, photoelectric, infrared, or radio frequency. In a preferred embodiment, signal beam 4 is a photoelectric beam. It is apparent that the intrinsic nature of signal beam 4 acts to establish a straight line signal between signal transmitting means 3 and signal receiving means 5. This signal beam establishes a perimeter "line" beyond which it is desired to prevent the presence of workers and machinery due to their close proximity to a danger, such as a roof edge over which they would be in danger of falling.

Figure 3:
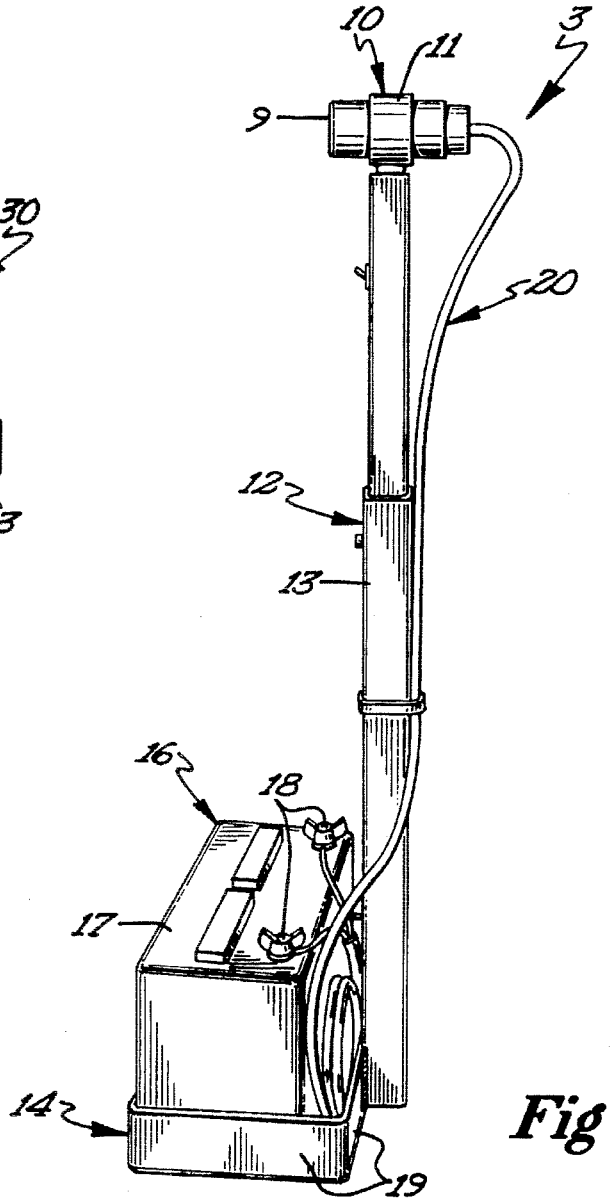
FIG. 3 is a side orthagonal view of the signal transmitting means mounted on its support means, including the power source.

As is shown is FIGS. 1 and 3, signal transmitting means 3 is comprised of a signal transmitter 9 attached to transmitter support means 12 by transmitter attachment means 10. In the preferred embodiment signal transmitter 9 is a photoelectric transmitter manufactured by Banner Engineering, and is identified by model number SM 30. While any one of a variety of attachment means may be used, in the preferred embodiment transmitter attachment means 10 are comprised of a flexible attachment strap 11 which surrounds signal transmitter 9 and attaches to support means 12 by screws (not shown) or other appropriate means. Attachment strap 11 may be loosened and/or removed from support means 12 for purposes of replacing the transmitter unit should that become necessary, or for purposes of aligning the signal transmitter with the signal receiver.

Signal transmitter 9 is powered by transmitter power means 16. While any variety of power means may be utilized, including line power, battery power, solar power or other available power sources, in the preferred embodiment transmitter power means 16 is a twelve volt storage battery 17. Such type battery 17 is often used on garden equipment because of its relatively light weight and high capacity. Power is channeled to signal transmitter 9 by means of electrical transmitter wiring harness 20 connecting the positive and negative terminals, each designated by the numeral 18, of transmitter battery 17, to signal transmitter 9 in an appropriate manner as will be well known in the art for the particular signal transmitter 9 selected.

Figure 2:
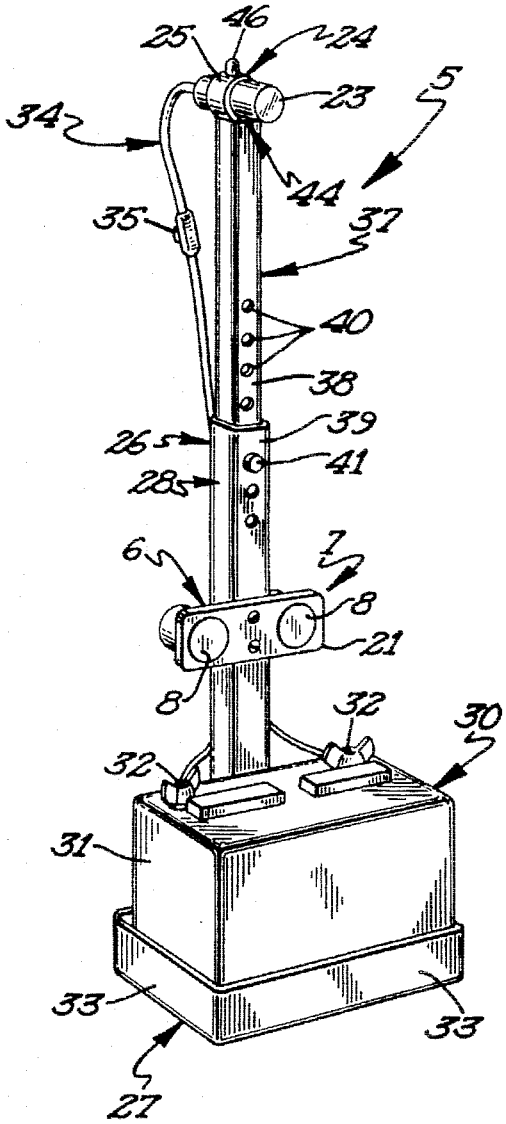
FIG. 2 is a front view of the signal receiving means mounted on its support means, including the power source.

As is shown in FIGS. 1 and 2, in the preferred embodiment signal receiving means 5 is comprised of a signal receiver 23 which is attached to receiver support means 26. This is accomplished utilizing receiver attachment means 24. In the preferred embodiment receiver attachment means 24 is comprised of a flexible receiver mounting strap 25 which is attached to support means 26 by way of screws (not shown) or other appropriate fasteners. Such a mounting means allows signal receiver 23 to be removably attached such that it may be replaced should the need arise.

It is, of course, necessary that signal transmitting means 3 and signal receiving means 5 be functionally matched such that they can transmit/receive signals of like kind. In the preferred embodiment, signal transmitter 9 is a photoelectric transmitter and signal receiver 23 is a photoelectric receiver tuned to the same photoelectric wave length. Other types of signals may also be utilized, including, but not limited to, other portions of the visible or invisible optical spectrum, or sonic waves.

As is shown in FIGS. 1 and 2 signal receiver 23 is powered by receiver power means 30, comprised of a receiver battery 31 connected to signal receiver 23 by means of electrical receiver wiring harness 34. Harness 34 is attached to the positive and negative terminals, each designated by the numeral 32, of receiver battery 31. The electrical interconnections provided between electrical receiver wiring harness 34, receiver battery 31 and signal receiver 23 may vary depending on the particular design of signal receiver 23 being utilized, and such wiring may be accomplished by any variety of means well known in the electrical wiring art.

Also functionally wired to signal receiver 23 and electrical receiver wiring harness 34 is alarm means 7 to signal the worker of his or her crossing of signal beam 4. In the preferred embodiment, alarm means 7 include a human-audible horn, shown having dual horn elements (one being a backup), each designated by the numeral 8, in FIGS. 1 and 2. Horn elements 8 are attached to receiver support means 26 by mounting bracket 21. It is the activation of horn 8 which audibly signals to the worker that he or she, or equipment he or she is operating, have crossed the boundary established by signal beam 4. Horn 8 may be any one of variety of designs, so long as it provides for a sufficiently audible signal such that a person would be aware of the signal over background noise at the job site.

Because it is necessary that horns 8 be normally off when signal transmitter 9 and signal receiver 23 have a signal beam 4 established between them, receiver electrical wiring harness 34 will provide for a normally open circuit to horn 8 when signal beam 4 is being transmitted. However, sensing means 6 are provided to detect a break in the continuity of transmission of signal beam 4 between signal transmitter 9 and signal receiver 23. Sensing means 6 then act to close the electrical circuit between receiver power means 30 and horns 8 to activate the horns. Horns 8 will then sound. The closing of the power circuit to horns 8 may be shut off by some type of timer having a set duration (not shown in the drawings), or by means of an on/off switch 35. Switch 35 is shown in FIG. 1 wired into electrical wiring harness 34. It may also have other circuit locations. The closing of switch 35, followed by its opening act to reactivate the transmission of signal beam 4 by signal transmitter 9 and its receipt by signal receiver 23, placing it in its active or "detecting" mode.

Sensing means 6 include an electrical circuit, or solid state component, provided in signal receiver 23, or signal receiver electrical wiring harness 34, which will close the electrical circuit between horn 8 and battery 31 when there is an interruption in the transmission of signal beam 4 as would occur if a worker or equipment interrupts the continuity of the signal beam. This in turn would provide power to horn 8 to activate it. A delay circuit, not shown in the drawings, may also be provided in electrical receiver wiring harness 34 which allows horn 8 to continue to sound for at least five seconds once it has been activated so that even a momentary breaking of signal beam 4 would result in a sufficient horn blast duration to be fully sensed by the worker. Alternatives to horns 8, which may be visually or audibly sensed by a human, may also be utilized within the practice of the present invention.

As is shown in FIGS. 1 through 3, each of signal transmitting means 3 and signal receiving means 5 are provided with apparatus which allows the height of signal beam 4 to be varied relative to surface 2. This capability is desirable in order to allow signal beam 4 to be selectively positioned to achieve the highest probability of interruption depending on the size and type of equipment being utilized. To achieve this, signal transmitter 9 is mounted on transmitter support means 12 which are comprised of vertical support member 13 having a lower end attached to a support base 14. Support base 14 is attached to vertical support member 13 by means of welds, similar to those designated by the numeral 15 in FIG. 1, or other appropriate means. In the preferred embodiment, transmitter support base 14 has four upturned sides, each designated by the numeral 19 which are sized to the perimeter of transmitter battery 17 to help hold it in place. Similarly, receiver support means 26, shown in FIG. 1, is comprised of a vertical support member 28 attached to a receiver support base 27. Welds, designated by the numeral 15 in FIG. 1 may be used to attach these two members. Support base 27 has four upturned sides, each designated by the numeral 33, which form a receptacle for receiver battery 31 to help hold it in place.

Height variation of signal beam 4 above surface 2 is provided by height adjustment means 37. Such means would have the same construction on each of signal transmitter support means 12 and signal receiver support means 26, so only one will be fully described. Height adjustment means 37 include a size variation in the diameter of each of two portions of transmitter vertical support member 13 and receiver vertical support member 26, forming first and second telescoping sections. First telescoping section 38 in receiver support member 28 slides in and out of second telescoping section 39 of vertical support member 28. A plurality of alignment holes, each designated by the numeral 40, is provided in each of telescoping sections 38 and 39. A set pin 41 is inserted into matching alignment holes 40 to establish the desired height of signal beam 4.

It has been found that because the spacing between signal transmitting means 3 and signal receiving means 5 may be very large, up to a distance in the range of 350 feet, alignment adjustment means 44 may be needed to align signal beam 4 between signal transmitter 9 and signal receiver 23 when the system is first installed in a work area, or when it is moved to a new location. This is accomplished by means of an adjustment light 46 attached to signal receiver 23 as shown in FIGS. 1 and 2. Adjustment light 46 is to be activated each time signal receiver 23 senses transmission of signal beam 4 by signal transmitter 9. The lateral and vertical orientation of signal transmitter 9 is adjusted by the operator using movement of the signal transmitting means and/or adjustment of transmitter attachment means 10 until signal beam 4 is established between signal transmitter 9 and signal receiver 23. At that time, adjustment light 46 is illuminated, and the proper alignment has been achieved. Any variety of wiring circuit, which may be included in receiver electrical harness 34, or in the circuitry of signal receiver 23, well known in the electrical art may be utilized to interconnect alignment light 46 to signal receiver 23 and receiver battery 31 to achieve the objective stated. An on/off circuit breaking switch, not shown in the drawings, may also be provided in receiver electrical harness 34 to allow signal light 46 to be switched in and out of the power circuit when the light is being used for beam alignment, or not being used, as the case may be.

The method of the present invention is directed toward the establishment of a perimeter warning "line" around the edge of a work area, such as a roof, utilizing an electronic or optical signal. The steps of the method include providing a signal transmitting means and a signal receiving means in spaced apart arrangement. Power means are provided for the signal transmitting means and the signal receiving means so that a signal can be transmitted continuously therebetween. By placing the signal transmitting means and signal receiving means along a selected portion of the work area perimeter, a signal beam is established. The signal receiving means are interconnected with alarm means. The alarm means are activated by sensing means which sense when the continuity of the signal is broken by the passage of a person or machinery between the signal transmitting means and signal receiving means. When the sensing means is triggered, power is turned on to the horn and it sounds an alarm. This warns workers that a person or machinery has strayed out of the guarded area, such as when a worker may stray unknowingly toward a roof edge, beyond the signal beam path.

Provided as part of the signal transmitting and receiving means are a signal transmitter and a signal receiver, respectively. The signal transmitter and receiver are each provided with mounting means that are adjustable in height to allow the height of the perimeter signal to be selectively varied. This allows the height to be selected for particular height of equipment in use. There is also provided a signal light that can be utilized to focus the transmitter beam onto the receiver when the equipment is first erected. The illumination of the light, or the lack thereof, tells the person setting up the system whether the receiver is in fact receiving a signal, meaning that the signal transmitter and signal receiver are aligned.

It should be realized that any variety of design expedients, well known in their specific art areas, may be used to make variations in the design of the preferred embodiment described herein. Further, the invention is applicable to any area wherein it is desirable to warn persons when they cross the established perimeter "line" whether this be on a building roof, in some other type of work area for crowd or personnel control generally. The preferred embodiment is merely one specific rendition of what may be a wide variety of specific embodiments that may be constructed incorporating the present invention.

What is claimed is:

1. An electronic perimeter warning system comprising, in combination:

(a) a plurality of signal transmitting means for transmitting detectable signal beams;

(b) a plurality of signal receiving means for receiving said detectible signal beams transmitted by said plurality of signal transmitting means;

(c) said plurality of signal transmitting means and said plurality of signal receiving means being movably positionable in spaced apart relationship wherein the plurality of receivers and transmitters define an enclosed perimeter such that said detectable signal beams are transmitted continuously therebetween;

(d) sensing means electrically connected to each signal receiving means for detecting when the transmission of said detectable signal beam between one of said signal transmitting means and one of said signal receiving means has been interrupted;

(e) a plurality of alarm means to provide audible signals to persons in the area in which the warning system is located;

(f) a plurality of alignment adjustment means each electrically connected to one of said signal receiving means for detecting when the transmission of said detectible signal beam between one of said signal transmitting means and one of said signal receiving means has been established and providing a visual signal to persons in the area in which the warning system is located; and (g) a plurality of electrical circuit means each functionally interconnecting one of said sensing means, said alignment adjustment means and said alarm means to activate said respective alarm means when continuity of said detectible signal has been interrupted and to activate said visual signal of said alignment adjustment means when said detectible signal has been established between said signal transmitting means and said signal receiving means.

2. The electronic perimeter warning system of claim 1 wherein:

(a) said signal transmitting means includes a signal transmitter; and (b) transmitter support means for positioning said signal transmitter above a surface including height adjustment means to selectively vary the height of said signal transmitter above the surface.

3. The electronic perimeter warning system of claim 2 wherein said height adjustment means is comprised of first and second sections, said first and second sections being selectively and telescopically positionable relative to one another to vary the distance between said signal transmitter and the surface.

4. The electronic perimeter warning system of claim 3 wherein said signal receiving means comprises, in combination: a signal receiver; and receiver support means for positioning said signal receiver above the surface including first and second sections, said first and second sections being selectively and telescopically positionable relative to one another to vary the distance between said signal receiver and the surface.

5. The electronic perimeter warning system of claim 1 wherein said alignment adjustment means include an alignment light that is illuminated when alignment is achieved between said signal transmitting means and said signal receiving means.

6. The electronic perimeter warning system of claim 1 further comprising, in combination: switch means for shutting off the alarm means while the signal transmitting means and the signal receiving means remain operational.

7. The electronic perimeter warning system of claim 2 wherein said signal transmitting means further comprises, in combination: a transmitter battery having a perimeter; and wherein the transmitter support means further includes a transmitter support base having a flat bottom and four upturned sides sized to the perimeter of the transmitter battery, with the height adjustment means being attached to the transmitter support base, with the flat bottom of the transmitter support base resting upon the surface.

8. The electronic perimeter warning system of claim 4 wherein said signal receiving means further comprises, in combination: a receiver battery having a perimeter; and wherein the receiver support means further includes a receiver support base having a flat bottom and four upturned sides sized to the perimeter of the receiver battery, with the first section of the receiver support means being attached to the receiver support base and the receiver being attached to the second section of the receiver support means, with the flat bottom of the receiver support base resting upon the surface.

9. The electronic perimeter warning system of claim 2 wherein the alarm means and the alignment adjustment means are attached to the signal receiving means.

10. Method for providing a warning line perimeter around a selected area comprising the steps of: providing a plurality of transmitters for transmitting detectable signal beams along straight lines; providing a plurality of receivers for receiving detectable signal beams; placing the transmitters and the receivers to enclose a perimeter; establishing the detectable signal beams between the transmitters and the receivers; providing visual signals to persons in the selected area when alignment means detects that the detectable signal beams are established between the transmitters and the receivers; and providing an audible signal to persons in the selected area after the detectable signal beams are established between the transmitters and the receivers when a person or machinery passes between one of the transmitters and the receivers and interrupts one of the detectable signal beams between one of the transmitters and the receivers.

11. The method of claim 10 further comprising the step of switching off the audible signal while the visual signal is being provided to establish the detectable signal beam between the transmitter and the receiver.

* * * * *